US010252297B2

(12) United States Patent
Benedetti

(10) Patent No.: US 10,252,297 B2
(45) Date of Patent: Apr. 9, 2019

(54) APPARATUS FOR SELECTING HORTICULTURAL PRODUCTS

(71) Applicant: UNITEC S.P.A., Lugo (IT)

(72) Inventor: Luca Benedetti, Ravenna (IT)

(73) Assignee: UNITEC S.P.A., Lugo (IT)

( * ) Notice: Subject to any disclaimer, the term of this patent is extended or adjusted under 35 U.S.C. 154(b) by 0 days.

(21) Appl. No.: 15/577,492

(22) PCT Filed: May 24, 2016

(86) PCT No.: PCT/IB2016/053032

§ 371 (c)(1),
(2) Date: Nov. 28, 2017

(87) PCT Pub. No.: WO2016/189459

PCT Pub. Date: Dec. 1, 2016

(65) Prior Publication Data

US 2018/0133758 A1 May 17, 2018

(30) Foreign Application Priority Data

May 28, 2015 (IT) ..... 102015000018551

(51) Int. Cl.
*B07B 1/14* (2006.01)
*B07B 1/46* (2006.01)
*B07B 13/07* (2006.01)

(52) U.S. Cl.
CPC ..... *B07B 1/145* (2013.01); *B07B 1/4636* (2013.01); *B07B 13/072* (2013.01)

(58) Field of Classification Search
CPC ..... B07B 1/145; B07B 1/4636
(Continued)

(56) References Cited

U.S. PATENT DOCUMENTS 3,065,777 A * 11/1962 Allen ..... A23N 15/02 99/537
3,770,123 A * 11/1973 Mraz ..... A22C 29/005 209/668

(Continued)

FOREIGN PATENT DOCUMENTS

EP 0704253 A1 * 4/1996 ..... A01D 17/06
EP 0704253 A1 4/1996

(Continued)

OTHER PUBLICATIONS

International Search Report dated Sep. 14, 2016 re: Application No. PCT/IB2016/053032; pp. 1-5; citing: US 2012/298565 A1, EP 0 704 253 A1 and U.S. Pat. No. 3,770,123 A.

(Continued)

*Primary Examiner* — Terrell H Matthews
(74) *Attorney, Agent, or Firm* — Cantor Colburn LLP

(57) ABSTRACT

An apparatus for selecting horticultural products includes an intake section leading to at least one passage lane defined by a pair of mutually close stems rotatably supported by a support and movement assembly and are interposed longitudinally between the intake section and a discharge section. between the pair of stems, kept inclined downward from the intake section to the discharge section, a longitudinal slot is disposed that can be crossed exclusively by debris and horticultural products having dimensions that are smaller than the width of the slot. The assembly includes a drive unit meshing with an end portion of each stem proximate to the intake section and elements for the free support of an end portion of each stem proximate to the discharge section.

6 Claims, 4 Drawing Sheets

(58) Field of Classification Search
USPC ..... 209/358
See application file for complete search history.

(56) References Cited

U.S. PATENT DOCUMENTS

| | | | | |
|---|---|---|---|---|
| 3,784,007 | A | 1/1974 | Skrmetta | |
| 4,901,861 | A | 2/1990 | Cicchelli | |
| 2004/0200696 | A1 | 10/2004 | Gross et al. | |
| 2012/0193272 | A1 | 8/2012 | Greve et al. | |
| 2012/0298565 | A1* | 11/2012 | Maile | B07B 1/14 209/606 |
| 2014/0131172 | A1 | 5/2014 | Greve | |

FOREIGN PATENT DOCUMENTS

| | | | |
|---|---|---|---|
| EP | 2684461 | A2 | 1/2014 |
| FR | 2824054 | A1 | 10/2002 |
| FR | 2824055 | A1 | 10/2002 |
| JP | S52146173 | U | 11/1977 |

OTHER PUBLICATIONS

Written Opinion dated Sep. 14, 2016 re: Application No. PCT/IB2016/053032; pp. 1-7; citing: US 2012/298565 A1, EP 0 704 253 A1 and U.S. Pat. No. 3,770,123 A.

International Search Report dated Aug. 30, 2016 re: Application No. PCT/IB2016/053028; pp. 1-4; citing: EP 2 684 461 A2, FR 2 824 055 A1, U.S. Pat. No. 4,901,861 A, US 2012/193272 A1, U.S. Pat. No. 3,784,007 A, US 2014/131172 A1, JP S52 146173 U, US 2004/200696 A1 and FR 2 824 054 A1.

Written Opinion dated Aug. 30, 2016 re: Application No. PCT/IB2016/053028; pp. 1-7; citing: EP 2 684 461 A2, FR 2 824 055 A1, U.S. Pat. No. 4,901,861 A, US 2012/193272 A1, U.S. Pat. No. 3,784,007 A, US 2014/131172 A1 and JP S52 146173 U.

* cited by examiner

APPARATUS FOR SELECTING HORTICULTURAL PRODUCTS

TECHNICAL FIELD

The present disclosure relates to an apparatus for selecting horticultural products.

BACKGROUND

As is known, large companies dedicated to the distribution and marketing of horticultural products are often equipped with lines that are at least partially automated and are capable of transporting, checking and/or packaging a large number of products of interest in the unit time.

Known lines are therefore already capable of performing several activities, such as for example washing, defect checking (and/or rejection or reprocessing of defective units), packaging and calibration, a term used to reference the selection of the horticultural products as a function of their dimensions.

It should be noted in this regard that calibration has a primary role in the automatic lines outlined so far, since even when they are intended for a single specific horticultural product (be it fruit or vegetable) they receive the goods to be processed directly from the harvesting fields and are therefore fed with indiscriminate masses of mutually heterogeneous products.

Along the lines, therefore, there are stations capable of selecting automatically the products as a function of the dimensions, in order to assign them to different downstream stations (which are thus fed with mutually homogeneous products) and/or package them in different packages as a function of their size.

Indeed due to the importance of this function (performed by stations that perform the desired selection mechanically or electronically), and due to the heterogeneous nature of the goods, the most modern lines have, upstream of the calibration station, an additional ("pre-calibration") station, which performs a preliminary selection of the horticultural products.

In greater detail, and with specific reference to lines dedicated to cherries, in the pre-calibration stations a stream of water that entrains with it the cherries to be selected affects a plurality of suspended cylinders, which are mutually parallel and rotate about their own axis.

The cylinders are inclined (downstream) and appropriately mutually spaced and contoured, so that a longitudinally oriented slot is formed between each pair of adjacent cylinders.

In this manner, as soon as the stream strikes the cylinders, the water, any leaves, stems and other debris fall directly below; minimum-size cherries (i.e., the only ones which, due to their small dimensions, are able to pass through the slot) may further fall slightly further on. Vice versa, the largest cherries continue their travel, sliding along the lateral surfaces of the cylinders (which rotate indeed to facilitate advancement) until they fall downstream of said cylinders.

Thus, in addition to removing leaves and other debris, the station performs a first division of the cherries into two groups (indeed as a function of dimensions), each of which is collected in a respective tank filled with water, which is of course arranged below the cylinders and makes the respective cherries available to the actual calibration stations.

However, this constructive solution is not devoid of drawbacks.

It should in fact be noted that in known pre-calibration stations the rotation of the cylinders is entrusted to a motor that actuates a series of gears, with which respective pins which protrude coaxially from the end directed downstream of the cylinders.

This configuration forces the need to keep the cylinders at a vertical level that is significantly higher than the level at which the upper edge of the collection tanks is located.

Only in this manner the motor and the gears that are responsible for the movement of the cylinders (indeed located below the lower ends of said cylinders) can find an adequate placement without having to be themselves immersed in the water of the tanks (an obviously unacceptable condition).

However, this entails a considerable leap for the cherries, when they fall from the slot or from the lower end of the cylinders into said tanks.

Although this usually is not a problem (due to the low weight) for the smallest cherries, the excessive leap is instead a highly unwelcome drawback for larger ones (which, as shown, slide along the entire length of the cylinders and fall beyond).

Larger cherries can in fact fall onto other cherries that are floating in the tank, bruising each other or otherwise becoming damaged, causing in any case a degree of defectiveness that is now unacceptable.

SUMMARY

The aim of the present disclosure is to solve the problems described above, by providing an apparatus that allows optimum preliminary selection (pre-calibration) of cherries or other horticultural products.

Within this aim, the disclosure provides an apparatus that is capable of performing the preliminary selection (pre-calibration) without damaging or deteriorating the treated horticultural products, be they cherries or others.

The disclosure further provides an apparatus that is capable of performing the preliminary selection (pre-calibration) without forcing leaps of excessive extent on the treated horticultural products, be they cherries or others.

The disclosure also provides an apparatus that ensures high reliability in operation.

The disclosure further provides an apparatus that can be obtained easily starting from commonly commercially available elements and materials. The disclosure also provides an apparatus that has low costs and is safe in application.

This aim, as well as these and other advantages that will become better apparent hereinafter, are achieved by providing an apparatus for selecting horticultural products, comprising an intake section for horticultural products, which leads to at least one passage lane defined by a pair of mutually close stems that are supported rotatably by a respective support and movement assembly and are interposed longitudinally between said intake section and a discharge section, between said at least one pair of stems, kept inclined downward from said intake section to said discharge section, there being a longitudinal slot that can be crossed exclusively by debris and horticultural products having dimensions that are smaller than the width of said slot, characterized in that said assembly comprises a drive unit which meshes, optionally indirectly, with a first end portion of each one of said stems that is proximate to said intake section, and respective elements for the free support of a second end portion of each one of said stems that is proximate to said discharge section.

BRIEF DESCRIPTION OF THE DRAWINGS

Further characteristics and advantages of the disclosure will become better apparent from the description of a preferred but not exclusive embodiment of the apparatus according to the disclosure, illustrated by way of nonlimiting example in the accompanying drawings, wherein.

DETAILED DESCRIPTION OF THE DRAWINGS

Figure 1:
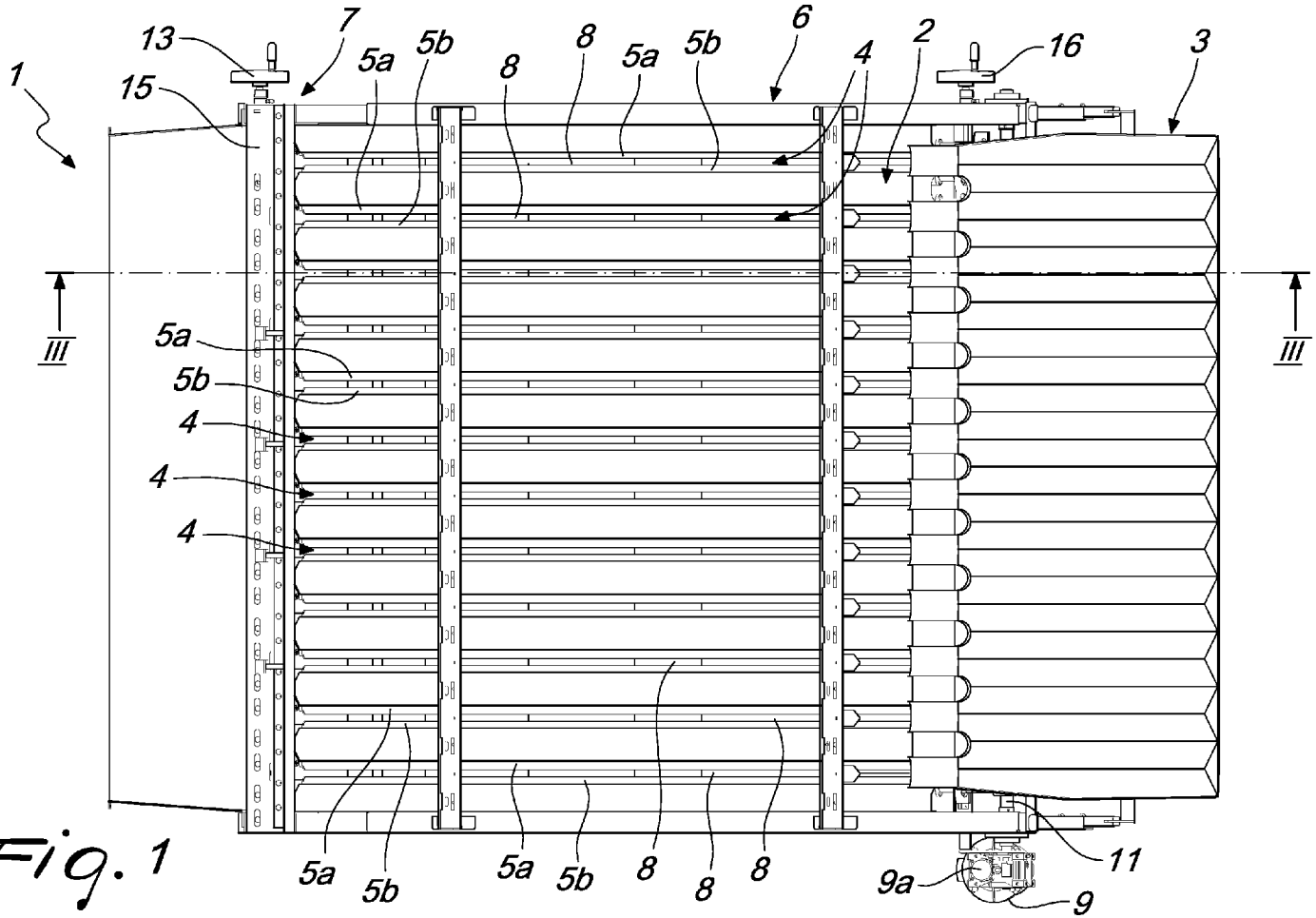
FIG. 1 is a top view of an apparatus according to the disclosure.
Figure 2:
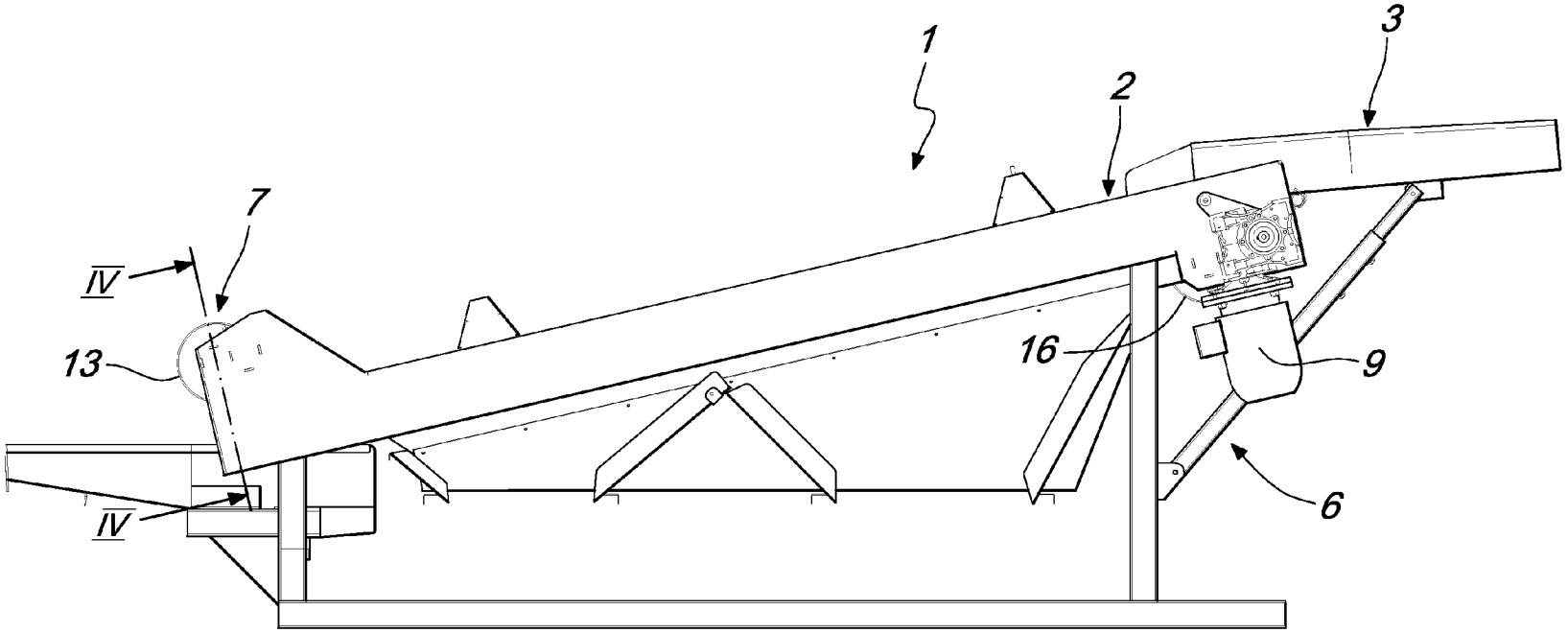
FIG. 2 is a side elevation view of the apparatus according to the disclosure.

With particular reference to the FIGS. 1-4, the reference numeral 1 generally designates an apparatus for selecting horticultural products, which comprises first of all an intake section 2 for said horticultural products.

It is specified that the apparatus 1 can find application in any point of lines for the processing of horticultural products (of any type), where indeed the need arises to divide them into at least two subgroups (indeed select them) as a function of their dimensions.

It should be noted, further, that the transport of the horticultural products along the path defined by the apparatus 1 can be entrusted exclusively to the force of gravity or be obtained in other manners, but in the preferred application these products are propelled by a fluid under pressure (preferably water) (which therefore cooperates with the force of gravity).

In the accompanying figures, for example, a constructive solution is proposed in which at the intake section 2 the products are in practice delivered from a distribution and conveyance tank 3 (which divides the horticultural products on a plurality of uniform rows indeed to facilitate the correct operation of the apparatus 1).

It is specified further right now that in the preferred application, to which reference shall be made often in the continuation of the present description, the horticultural products treated (selected) by the apparatus 1 are cherries, but it is useful to specify again that this does not exclude the use of said apparatus 1 in relation to different types of fruit or vegetable.

In any case, the intake section 2 leads in an upward region to at least one passage lane 4 that is defined by a pair of mutually close stems 5*a*, 5*b*.

Figure 4:
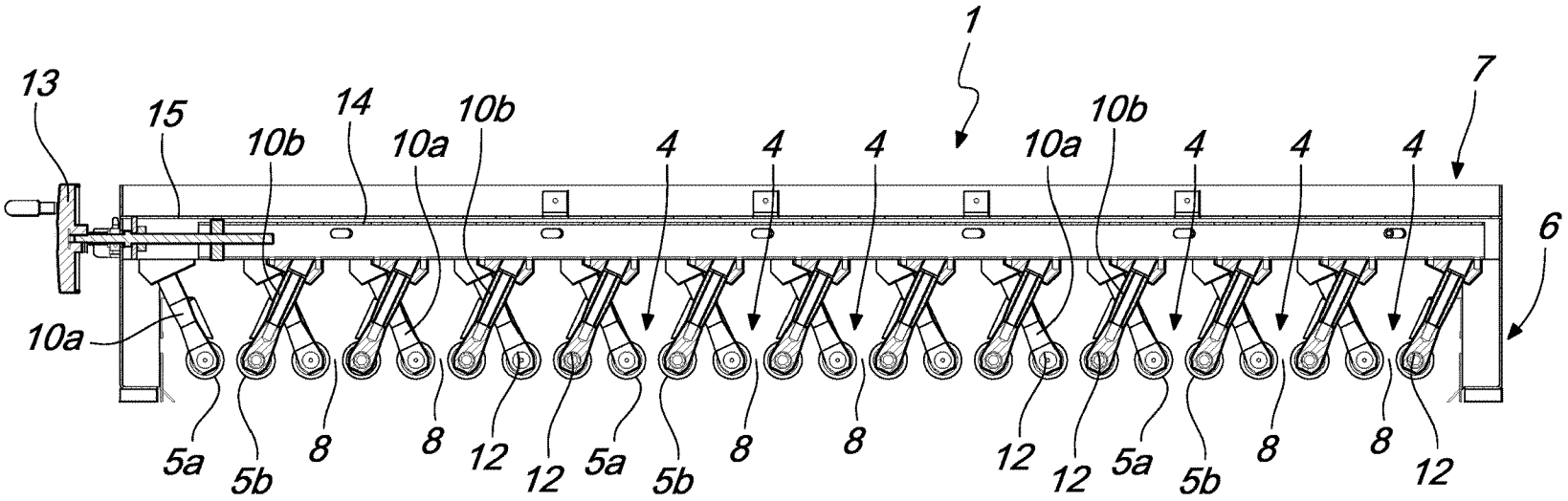
FIG. 4 is a sectional view of FIG. 2, taken along the line IV-IV.

The stems 5*a*, 5*b* are supported rotatably by a respective support and movement assembly 6 and are interposed longitudinally between the intake section 2 and a discharge section 7 (which substantially corresponds to the section of FIG. 4).

Furthermore, between the pair of stems 5*a*, 5*b*, which are kept inclined downward from the intake section 2 to the discharge section 7 (therefore from upstream to downstream), there is a longitudinal slot 8 that can be crossed only by debris and horticultural products that have dimensions that are smaller than the width of such slot 8.

Vice versa, therefore, larger cherries are forced to travel along the entire lane 4 (or in any case to continue until they reach a point of the slot 8 that has a greater width) and therefore fall further downstream.

It should be noted that the components and the operation outlined above therefore allow to perform the desired selection: as soon as the stream of water and cherries strikes the stems 5*a*, 5*b*, the leaves, stems and other small debris fall immediately through the slot 8; the smaller cherries also fall with them (or directly after) and thus fall, for example, into a first collection tank.

On the other hand, the larger cherries continue their travel and fall further downstream into a second collection tank.

From the two collection tanks the cherries can then be picked up by different devices and/or be intended for different treatments, as a function of the different dimensions.

The apparatus 1 in practice preferably performs a precalibration function, understood indeed as a first preliminary division of a chaotic mass of cherries into two at least partially homogeneous subgroups.

According to the disclosure, the assembly 6 comprises a drive unit 9 which meshes, optionally indirectly (i.e., by means of respective transmission elements), with a first end portion of each stem 5*a*, 5*b* proximate to the intake section 2.

Furthermore, the assembly 6 comprises respective elements 10*a*, 10*b* for the free support of a second end portion of each stem 5*a*, 5*b* directed toward the discharge section 7.

It should be noted that the methods for movement and support of the stems 5*a*, 5*b* indicated above allow right now to achieve the intended aim: the (bulky) elements that are responsible for moving the stems 5*a*, 5*b* are in fact now arranged proximate to the intake section 2, at which the stems 5*a*, 5*b* (with their first end portion, to which indeed said elements are connected) have a higher vertical elevation.

Vice versa, at the second end portion, arranged at a lower vertical height, the stems 5*a*, 5*b* are simply supported by the elements 10*a*, 10*b* having a reduced space occupation and besides, as will become apparent hereinafter, they can be arranged above said stems 5*a*, 5*b*.

Therefore, in the apparatus 1 according to the disclosure a free space of considerable extent is not required below the lower flap of the stems 5*a*, 5*b*, which can thus be kept proximate to the underlying collection tanks, thus effectively reducing the leap that is imposed on the cherries and indeed achieving the intended aim.

In particular, the apparatus 1 comprises a plurality of lanes 4, which are defined by respective pairs of adjacent stems 5*a*, 5*b*, which are supported rotatably by the assembly 6 and are interposed longitudinally between the sections 2, 7 (from upstream to downstream). As can be deduced also from the accompanying figures, respective longitudinal slots 8 are therefore defined between pairs of adjacent stems 5*a*, 5*b*.

As clearly shown by FIGS. 1 and 4, in the configuration that is proposed (by way of nonlimiting example) each stem designated by 5*a* is alternated with a respective stem, designated by 5*b*, and for an observer located downstream (FIG. 4) the lanes 4 and the slots 8 are defined exclusively to the right of each stem 5*a* (and correspondingly to the left of each stem 5*b*), while the space directly to the left of each stem 5*a* is unused.

It is useful to specify again in any case that use in different manner of the various interspaces defined between the stems 5*a*, 5*b* as a function of the specific requirement is not excluded.

In the preferred embodiment, shown in the accompanying figures by way of example of the disclosure, an output shaft 9*a* of the drive unit 9 (for example an electric motor) is connected, optionally by means of respective gears, to a motion transmission shaft 11.

The transmission shaft 11 in turn is coupled, optionally indirectly (therefore optionally by means of additional gears), to each first end portion of the stems 5*a*, 5*b*, so as to indeed give them the desired rotary motion about their own axis (which is required to facilitate the sliding of the largest cherries along the respective lateral surfaces and thus make them fall downstream).

In an embodiment of considerable practical interest, mentioned by way of non-limiting example, each element 10*a*, 10*b* for free support is constituted substantially by a respective arm, which is indeed adapted to support the respective stem 5*a*, 5*b* from above.

As clearly shown for example by FIG. 4, each arm is in fact anchored in an upward region to the support and movement assembly 6 and is provided in a downward region with a seat 12 for rotary accommodation for the respective second end portion of a corresponding stem 5*a*, 5*b*.

Figure 3:
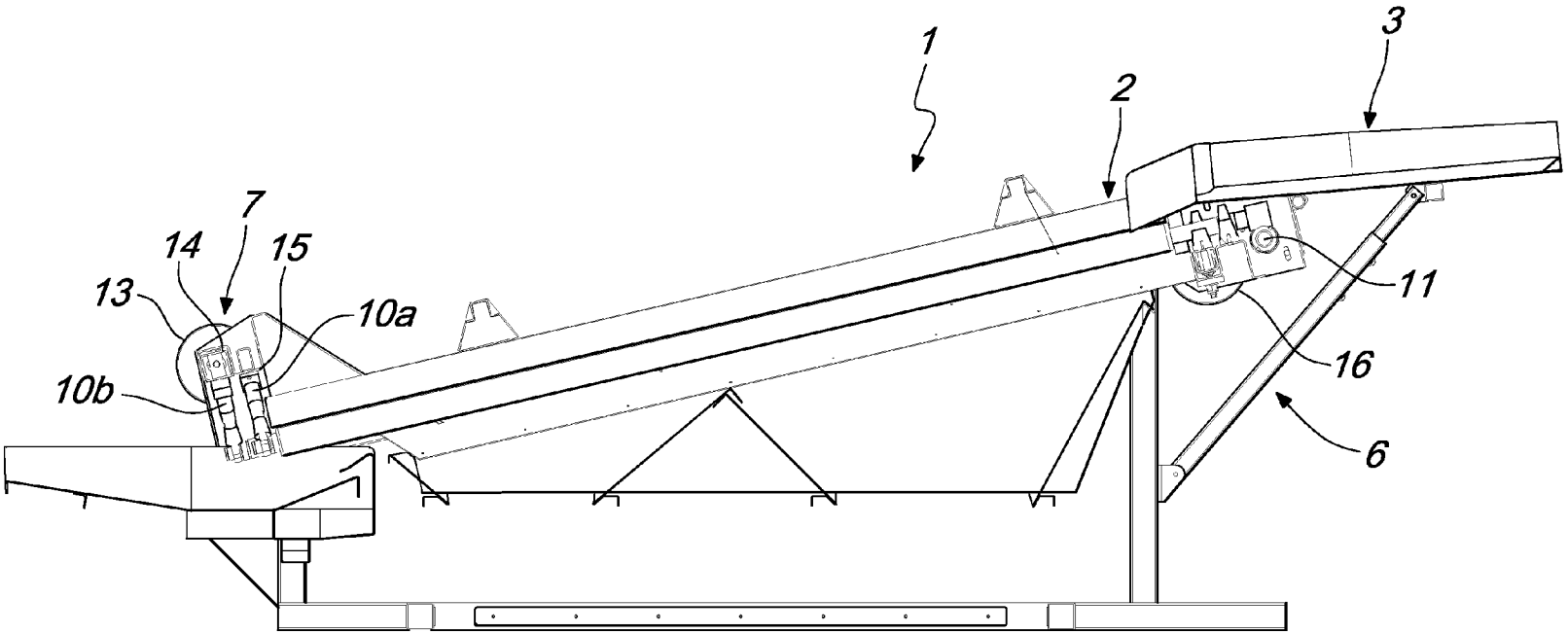
FIG. 3 is a sectional view of FIG. 1, taken along the line III-III.

Furthermore, usefully each arm (each element 10*a*, 10*b*) is inclined with respect to the vertical: as can be deduced also from FIG. 3, with this configuration each arm remains spaced from the respective (end) portion of the passage lane 4, which in practice corresponds substantially to the region of space that is interposed between the corresponding lateral surfaces of the second end portions of the stems 5*a*, 5*b*.

In this manner the danger that the cherries in transit might strike the arms, becoming damaged and/or diverting from the preset trajectory, is avoided.

Conveniently, the apparatus 1 according to the disclosure comprises means for the adjustment of the position of at least one stem 5*b*, so as to be able to vary selectively the shape and/or width of the respective slot 8.

It should be noted that this possibility increases significantly the versatility of the apparatus 1 according to the disclosure, since by acting on the adjustment means (for example in the manners that will be described hereinafter) it is possible to change the dimensional limit (the width of the slots 8) that discriminates between the cherries that are able to pass through said slots 8 and the ones that instead travel along the entire lane 4. Besides, by way of the adjustment means and thanks to the possibility to vary the shape and dimensions of the slots 8 it is also possible to reconfigure such apparatus 1 according to the disclosure to select a different type of fruit (or other horticultural product in general) to be divided according to different dimensional criteria.

In particular, in the constructive solution proposed therefore in the accompanying figures by way of example, the means comprise a first actuation unit 13 (a first knob that can be operated by the user) for actuating the transverse movement of a slider 14 that is integral with at least one supporting arm of the second end of a corresponding stem 5*b*.

By means of the transverse movement (i.e., substantially horizontally and at right angles to the longitudinal extension of the stems 5*a*, 5*b*) it is thus possible to change (albeit slightly) the inclination of the stems 5*b* and therefore achieve the consequent variation of the shape and/or width of the respective slot 8 (for example keeping the corresponding adjacent stem 5*a* fixed).

In particular, each pair of stems 5*a*, 5*b* that defines a respective slot 8 is composed of a first stem 5*a* (on the left, for an observer located downstream) and a second stem 5*b* (on the right for a downstream observer). The first stem 5*a* is therefore supported in the corresponding second end by a corresponding arm (element 10*a*) that is anchored in an upward region to a fixed cross-member 15 defined by the support and movement assembly 6. Vice versa, the second stem 5*b* is supported in the corresponding second end by a corresponding arm (element 10*b*) that is anchored in an upward region to the slider 14 and is guided slidingly by said cross-member 15 (or by another fixed element of the support and movement assembly 6).

It should be noted therefore that by acting exclusively on the second end portions of the stems 5*b* it is possible to vary the shape of the respective slot 8, increasing or decreasing the width of the upstream portion with respect to the width of the downstream portion, as a function of the specific requirements.

The means may further comprise a second actuation unit 16 (a second knob), which can be activated by a user for the transverse movement of the first end of a respective stem 5*a*, 5*b* and the consequent variation of the shape and/or width of the respective slot 8.

It should be noted first of all that the provision of apparatuses 1 according to the disclosure provided with adjustment means that act exclusively on the first end portions (or also on others as well) as a function of the specific requirements is not excluded.

However, in the embodiment proposed in the accompanying figures, the adjustment means comprise both the first actuation unit 13 and the second actuation unit 16: this evidently ensures maximum versatility to the apparatus 1.

The manners in which the second actuation unit 16 adjusts the movement of the first end portions of the stems 5*a*, 5*b* may be similar to the ones described in relation to the first actuation unit 13 or may be different according to the specific requirements.

Usefully, each stem 5*a*, 5*b* has a cylindrical shape, although it is not excluded to adopt different shapes and contours, for example conical ones, to define slots 8 having different shapes.

If therefore the stems 5*a*, 5*b* have such cylindrical shape (and mutually parallel axes) they may define slots 8 that have a constant width: by imposing the same displacement to the first and second end portions (by means of the units 13, 16), it is therefore possible to vary uniformly such width along its entire longitudinal extension. Vice versa, with displacements of different extent, or by acting on just one of the units 13, 16, it is possible to shape the slots 8 differently, so that for example they widen downstream.

Operation of the apparatus according to the disclosure is as follows.

Upstream of the apparatus 1, the cherries are redistributed in various channels by way of the distribution and conveyance tank 3, from which therefor the cherries fall in tidy rows into the passage lanes 4, substantially at the intake section 2.

As shown, each passage lane 4 is affected, along the entire length, by a respective slot 8 that is delimited by adjacent stems 5*a*, 5*b*: debris of various kinds, optionally entrained by the water together with the cherries, can thus fall immediately through the slot 8.

The smallest cherries also fall together with the debris (or shortly thereafter), while the larger cherries advance along the lane 4 to fall further downstream, at an optional widening of the slot 8 or simply beyond the discharge section 7 and the stems 5*a*, 5*b*. The apparatus 1, in other words, performs selection by making cherries of different sizes fall automatically in different points of the line.

By way of the choice to connect the drive unit 9 to the first end portion (arranged at a higher level) of each stem 5*a*, 5*b*, and by resorting to simple supporting elements 10*a*, 10*b* for the second end portions, in particular the latter and in general the entire stems 5*a*, 5*b* can be kept proximate to the free surface of the water that fills the underlying collection tanks.

This positive effect is increased by the preferred choice of supporting from above the second portions by means of elements 10*a*, 10*b*, which in turn are fixed in an upward region to the support and movement assembly 6 (to the cross-member 15 or to the slider 14).

In this configuration the second portions of the stems 5*a*, 5*b* in fact can be kept even closer to the collection tanks, until they almost skim them, without compromising in any way the correct operation of the apparatus 1.

Moreover, a very small leap (from the slot 8 to the collection tank) is imposed on the cherries, its value being however particularly modest for larger fruits (the ones for which the risk of bruising is higher), which indeed fall proximate to the discharge section 7 (of the second end portions of the stems 5*a*, 5*b*), kept at the lowest vertical height.

The configuration obtained above therefore allows to perform the selection (calibration) without subjecting the treated horticultural products, be they cherries or others, to the risk of impacts, bruising or damage in general and therefore without deteriorating them in any way (as instead occurs with known apparatuses due to the excessive leap that is imposed).

Moreover, it is stressed that the adjustment means can provide further functionalities to the apparatus 1 according to the disclosure, ensuring in fact the possibility to vary at will the selection parameters (the discriminating dimensional limit for the division of the cherries into dimensionally uniform subgroups).

Finally, it is specified again that the apparatus 1 according to the disclosure ensures the preservation of the quality of the treated horticultural products (without causing damage or bruising) also by way of the choice to arrange at an angle (in a V-shaped configuration) the stems 5*a*, 5*b* that define the slots 8 and the lanes 4, since in this configuration they do not hinder the advancement of the cherries.

In practice it has been found that the apparatus according to the disclosure achieves fully the intended aim, since resorting to a support and movement assembly that comprises a drive unit that meshes with a first end portion of the stems that define the slots, proximate to the input section, and respective elements for the free support of a second end portion of such stems that is proximate to the discharge section allows to perform the optimum preliminary selection (pre-calibration) of cherries or other horticultural products.

The disclosure thus conceived is susceptible of numerous modifications and variations; all the details may further be replaced with other technically equivalent elements.

In the examples of embodiment shown, individual characteristics, given in relation to specific examples, may actually be interchanged with other different characteristics that exist in other exemplary embodiments.

In practice, the materials used, as well as the dimensions, may be any according to requirements and to the state of the art.

The invention claimed is:

1. An apparatus for selecting horticultural products, comprising an intake section for horticultural products, which leads to at least one passage lane defined by a pair of mutually close stems supported rotatably by a respective support and movement assembly and interposed longitudinally between said intake section and a discharge section, between said at least one pair of stems, kept inclined downward from said intake section to said discharge section, there is a longitudinal slot that can be crossed exclusively by debris and horticultural products having dimensions that are smaller than the width of said slot, said assembly comprising a drive unit which meshes with a first end portion of each one of said stems that is proximate to said intake section, and respective elements for the free support of a second end portion of each one of said stems that is proximate to said discharge section, wherein each one of said elements for free support is constituted by an arm that is anchored in an upper region to said assembly and has, in a lower region, a seat for rotatable accommodation of a respective said second end portion of a corresponding said stem;

each one of said arms being inclined, with respect to the vertical, in order to remain spaced from the respective portion of said passage lane, which corresponds substantially to the region of space that is interposed between the corresponding lateral surfaces of said second end portions of said stems;

said apparatus further comprising means for adjusting the position of at least one of said stems, in order to vary selectively the shape and/or width of the respective said slot said means for adjusting the position of at least one of said stems comprising a first unit for actuating the transverse movement of a slider that is integral with at least one said arm for supporting said second end of a corresponding said stem, for a consequent variation of the shape and/or width of the respective said slot.

2. The apparatus according to claim 1, further comprising a plurality of said lanes, defined by respective pairs of said adjacent stems, supported rotatably by said assembly and interposed longitudinally between said sections, respective said longitudinal slots being defined between pairs of said adjacent stems.

3. The apparatus according to claim 2, wherein an output shaft of said drive unit is connected, by means of respective gears, to a motion transmission shaft coupled to each one of said first end portions of said stems.

4. The apparatus according to claim 1, wherein each one of said pairs of stems that defines respective said slots is composed of a first stem supported in the corresponding said second end by a corresponding said arm that is anchored in an upward region to a fixed cross-member, which is defined by said assembly, and by a second stem supported in the corresponding said second end by a corresponding said arm that is anchored in an upward region to said slider, which is guided slidingly by said cross-member.

5. The apparatus according to claim 1, wherein said means for adjusting the position of at least one of said stems comprise a second unit for actuating a transverse movement of said first end of a respective said stem, for the consequent variation of the shape or the width of the respective said slot.

6. The apparatus according to claim 1, wherein each one of said stems has a substantially cylindrical shape.

* * * * *